US005638736A

United States Patent [19]

Murakami et al.

[11] Patent Number: 5,638,736

[45] Date of Patent: Jun. 17, 1997

[54] WAVE CAM TYPE COMPRESSOR

[75] Inventors: Kazuo Murakami; Toshiro Fujii; Kazuaki Iwama; Katsuya Ohyama, all of Kariya, Japan

[73] Assignee: Kabushiki Kaisha Toyoda Jidoshokki Seisakusho, Kariya, Japan

[21] Appl. No.: 539,228

[22] Filed: Oct. 4, 1995

Related U.S. Application Data

[63] Continuation-in-part of Ser. No. 539,128, Oct. 4, 1995, Pat. No. 5,542,340, and Ser. No. 538,238, Oct. 3, 1995, which is a continuation-in-part of Ser. No. 475,043, Jun. 7, 1995, which is a continuation-in-part of Ser. No. 363,609, Dec. 23, 1994, which is a continuation-in-part of Ser. No. 254,970, Jun. 7, 1994.

[30] Foreign Application Priority Data

Oct. 5, 1994 [JP] Japan ..... 6-241587

[51] Int. Cl.[6] ..... F01B 3/00

[52] U.S. Cl. ..... 92/71; 417/269; 92/138; 74/60

[58] Field of Search ..... 92/71, 12.2, 138; 417/269; 74/60

[56] References Cited

U.S. PATENT DOCUMENTS

| | | | |
|---|---|---|---|
| 2,176,300 | 10/1939 | Fette . | |
| 4,756,239 | 7/1988 | Hattori et al. . | |
| 5,228,841 | 7/1993 | Kimura et al. | 417/269 |
| 5,293,810 | 3/1994 | Kimura et al. | 92/12.2 |
| 5,336,056 | 8/1994 | Kimura et al. | 417/269 |
| 5,452,647 | 9/1995 | Murakami et al. | 92/71 |
| 5,477,773 | 12/1995 | Murakami et al. | 74/60 |
| 5,483,867 | 1/1996 | Ikeda et al. | 92/71 |

*Primary Examiner*—Thomas E. Denion

*Attorney, Agent, or Firm*—Brooks Haidt Haffner & Delahunty

[57] ABSTRACT

A wave cam 17 is rotatably supported by a drive shaft 13 in cylinder blocks 11, 12. Front and rear cam surfaces 17A, 17B of the wave cam 17 are defined by the surface of a predetermined imaginary cylindroid. Semi-spherical shoes 18, 19 are interposed between each cam surface 17A, 17B and each double-headed piston 16, which is accommodated in each cylinder bore 11*a*, 12*a*. Each shoe 18, 19 has a spherical surface 18*a*, 19*a* and a flat surface 18*b*, 19*b*. An imaginary circumference C0 corresponding to the arrangement of centers Q1, Q2 of the spherical surfaces 18*a*, 19*a of the shoes* 18, 19, respectively, is defined on each cam surface 17A, 17B. An imaginary circumference C1 corresponding to the arrangement of axes L1 of each cylinder bore 11*a*, 12*a* is also defined on each cam surface 17A, 17B. The center of both circumferences C0, C1 coincide with an axis L0 of the drive shaft 13. The radius R1 of the circumference C0 is larger than the radius of the circumference C1. Integral rotation of the drive shaft 13 and the wave cam 17 reciprocates each piston 16 in the cylinder bores 11*a*, 12*a* via the shoes. The centers Q1, Q2 of each spherical surface orbits outside of the circumference C1 on the associated cam surface 17A, 17B.

24 Claims, 7 Drawing Sheets

WAVE CAM TYPE COMPRESSOR

This application is a continuation-in-part application of U.S. patent application Ser. No. 08/539,128, filed on Oct. 4, 1995, now U.S. Pat. No. 5,542,340, and of copending U.S. patent application Ser. No. 08/538,238, filed on Oct. 3, 1995, which is a continuation-in-part application of copending U.S. patent application Ser. No. 08/475,043, filed on Jun. 7, 1995, which is a continuation-in-part application of copending U.S. patent application Ser. No. 08/363,609, filed on Dec. 23, 1994, which is a continuation-in-part application of copending U.S. patent application Ser. No. 08/254,970, filed on Jun. 7, 1994.

BACKGROUND OF THE INVENTION

1. Field of the Invention

The present invention relates generally to a compressor which compresses fluid, introduced into cylinder bores, by reciprocating pistons. More particularly, it pertains to a wave cam plate type compressor which reciprocates pistons by rotating a wave cam integrally attached to a drive shaft.

2. Description of the Related Art

Prior art wave cam type compressors are provided with a drive shaft, a wave cam, and pistons accommodated in associated cylinder bores. The wave cam is integrally fixed to the drive shaft and connected to each piston. In this type of compressor, fluid introduced into the cylinder bores is compressed by reciprocating movement of the pistons within the bores. The reciprocation is caused by integral rotation of the drive shaft and the wave cam. Japanese Unexamined Patent Publication No. 57-110783 and Japanese Unexamined Utility Model Publication No. 63-147571 disclose such compressors.

In the compressor of the Japanese Unexamined Patent Publication No. 57-110783, a wave cam, having a front and a rear surface, and double-headed pistons is disclosed. A roller, interposed between each cam surface and each piston, is rotatably and permanently fitted to each piston. Rotation of the wave cam rolls the rollers with respect to the wave cam surfaces thus axially displacing the contact point between the roller and the piston to reciprocate the pistons. The reciprocation of the pistons is based on a displacement curve of the cam surface. In the compressor of Japanese Unexamined Utility Model publication No. 63-147571, a wave cam, having a cam groove respectively defined on its front and rear surfaces, and double-headed pistons are employed. A ball is interposed between each cam groove and each piston. This compressor differs from the former compressor in that balls are utilized instead of rollers and that the reciprocation of the pistons is based on a displacement curve of the cam groove during rotation of the wave cam.

In a swash plate type compressor, which employs a swash plate in place of the wave cam, the swash plate is rotated by a drive shaft to reciprocate pistons accommodated in cylinder bores for compression of fluid supplied to the bores. In this compressor, periodic displacement of a point following the swash plate surface during one rotation of the swash plate is represented by a single cycle sine wave curve. Hence, one compression stroke is performed per rotation of the drive shaft in the swash plate type compressor. On the other hand, in a wave cam type compressor, periodic displacement of a point following the wave cam surface during one rotation of the wave cam shows a plurality of sine wave curve cycles. Hence, a plurality of compression strokes are performed per rotation of the drive shaft in the wave cam type compressor. Thus a wave type cam compressor has a larger compressing volume per rotation then a swash plate type compressor.

In a wave cam type compressor, the roller or the ball is interposed between each cam surface and each associated piston. Each roller or ball rolls with respect to the wave cam. Linear contact takes place between the outer surface of the rollers and the cam surface when the rollers roll. Point contact takes place between the outer surface of the ball and the cam surface when the ball rolls. However, a microscopic view of the portions which contact the cam surface on the outer surface of the roller or ball reveals resilient deformation caused by the pressure (hereinafter referred to as "contact pressure") applied to the roller or ball during contact with the cam surface as the roller or ball rolls thereon. That is, the resilient deformation of the cam surface caused by the roller or ball leads to planar contact between the outer surface of the roller or ball and the resiliently deformed cam surface of the wave cam. Accordingly, it is preferable that the contact pressure be low. Low contact pressure is an important factor for improving the durability of the compressor. The longer the length of linear contact between the outer surface of the roller and the can surface of the wave cam is, or the smaller the curvature of the rollers of balls is (i.e., the larger the radius of curvature of the roller or ball), the smaller the contact pressure is. In other words, a small curvature of the rollers or balls, which allows more surface area of the roller or the ball to come into contact with the cam surface, reduces the contact pressure.

When a roller is interposed between the cam surface of the wave cam and the piston, contact pressure can be reduced by lengthening the roller along its axial direction or enlarging the diameter of the roller. When a ball is interposed between the cam surface of the wave cam and the piston, contact pressure can be reduced by enlarging the diameter of the ball. However, a roller or ball is retained in a recess defined in the double-headed piston of the wave cam type compressor. Therefore, the length of the roller, the diameter of the roller, and the ball diameter are limited in relation to the diameter of the piston. In other words, it is necessary for the diameter of the piston to be enlarged to make the length and diameter of the roller or ball diameter larger. A piston with a larger diameter will lead to enlargement of the compressor.

SUMMARY OF THE INVENTION

Accordingly, it is a primary objective of the present invention to provide a wave cam type compressor having an enhanced durability without enlarging the size of the compressor.

A further objective of the present invention is to provide wave cam type compressor with a smaller size.

To achieve the foregoing objectives, a wave cam type compressor includes a wave cam body mounted on a drive shaft for an integral rotation and a piston operably connected to the cam body. The cam body has a cam surface for driving the piston. A shoe is interposed between the cam surface end the piston to follow a predetermined orbital path on the cam surface. A rotation of the drive shaft is converted into a reciprocal movement of the piston with a predetermined piston stroke between a top dead center and a bottom dead center in a cylinder bore to compress fluid supplied to the cylinder bore. The shoe has a spherical surface. An axis of the drive shaft is spaced from a center of the spherical surface by a larger distance thee from an axis of the cylinder bore.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a wave type compressor according to the present invention will now be described with reference to the FIGS. 1 through 9.

Figure 1:
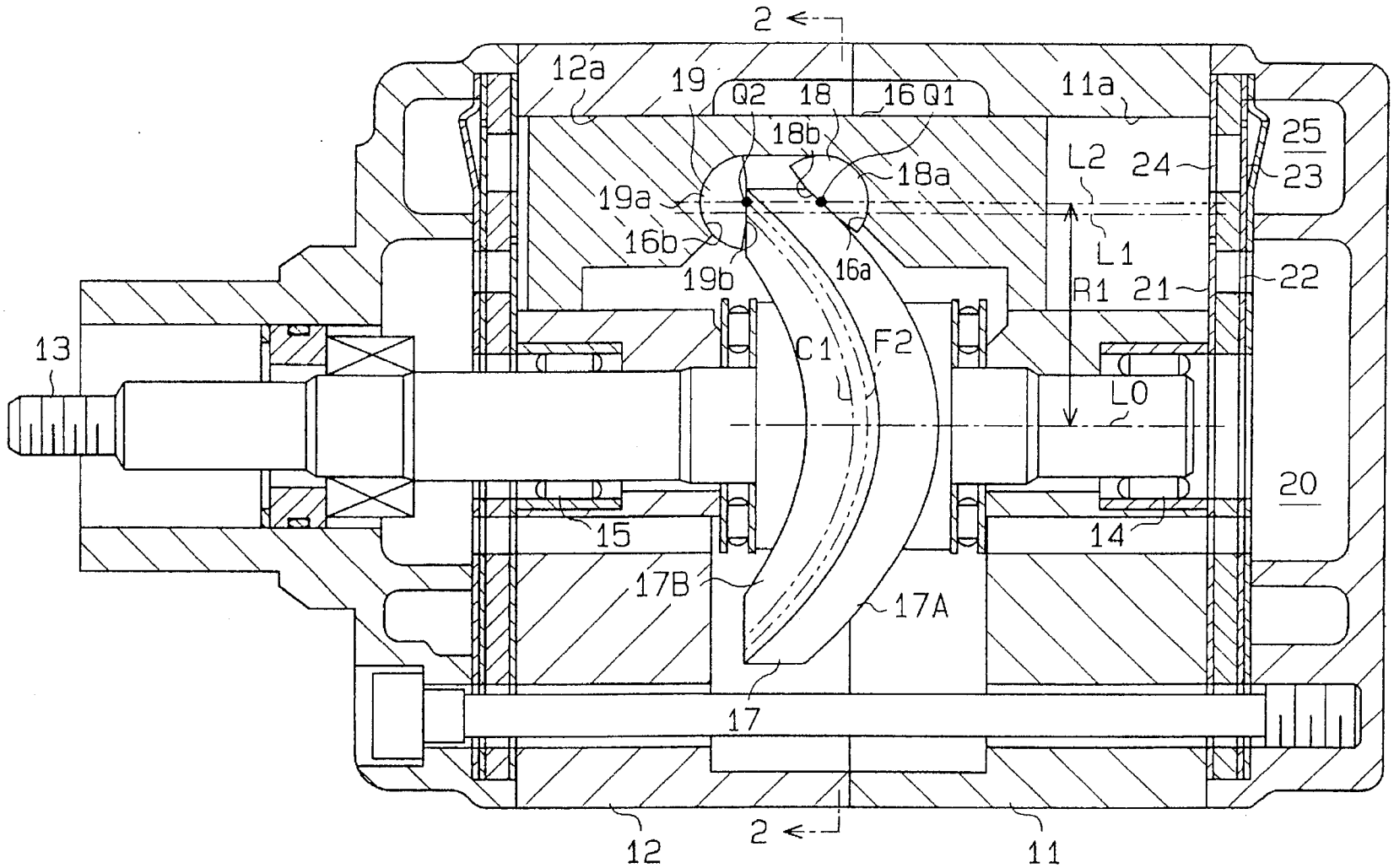
FIG. 1 is a cross-sectional view showing a wave cam type compressor according to a first embodiment of the present invention.

As shown in FIG. 1, a drive shaft 13 is rotatably supported in a pair of cylinder blocks 11, 12 by radial bearings 14, 15. Pairs of longitudinally aligned cylinder bores 11*a*, 12*a* are formed in the two cylinder blocks 11, 12 along the axial direction of the drive shaft 13. The cylinder bores 11*a*, 12*a* are arranged about the shaft 13 at equal angular intervals. A reciprocal double-headed piston 16 is accommodated in each pair of cylinder bores 11*a*, 12*a*. The piston 16 is provided with a piston head on each end.

A wave cam 17 is integrally fixed to the drive shaft 13. The wave cam 17 has a front cam surface 17A and a rear cam surface 17B. Semi-spherical shoes 18, 19 are interposed between each cam surface 17A, 17B and each piston 16. Each shoe 18, 19 has a spherical surface 18*a*, 19*a* and a flat surface 18*b*, 19*b*. The spherical surfaces 18*a*, 19*a* are received in associated recess portions 16*a*, 16*b* which are formed in the piston 16. The flat surfaces 18*b*, 19*b* slide on the associated cam surfaces 17A, 17B. Centers Q1, Q2 of the spherical surfaces 18*a*, 19*a* respectively coincide with the centers of the flat surfaces 18*b*, 19*b*.

An imaginary circumference C0, or an imaginary circle corresponds to the arrangement of the centers Q1, Q2 of the respective spherical surfaces 18*a*, 19*a*. As shown in FIGS. 1 through 3 and FIGS. 5 through 10, a set of movement curves F1, F2 on the cam surfaces 17*a*, 17*b*, respectively, are defined by the intersection of an imaginary cylinder having an axis coinciding with L0 and a circumference equal to C0. The center of the circumference C0 coincides with the axis L0 of the drive shaft 13 and the radius of the circumference C0 is R1 as shown in FIG. 1. A point following the movement curves F1, F2 is periodically and alternately displaced forward and backward twice in a direction parallel to both the axis L0 of the drive shaft 13 and axes L1 of the cylinder bores 11*a*, 12*a* during one rotation of the wave cam 17. Since the centers Q1, Q2 of the spherical surfaces 18*a*, 19*a* respectively coincide with the centers of the flat surfaces 18*b*, 19*b*, the centers Q1, Q2 constantly elide on each cam surface 17A, 17B along the associated curves F1, F2. In addition, movement of the pistons 16, accommodated in the cylinder bores 11, 12, is restricted to reciprocation along the direction of the axes L1 of the cylinder bores 11*a*, 12*a*. Accordingly, reciprocal movement of the pistons 16 within the associated cylinder bores 11*a*, corresponds to the displacement of the pistons 16 along movement curves F1, F2 during rotation of the wave cam 17.

Figure 3:
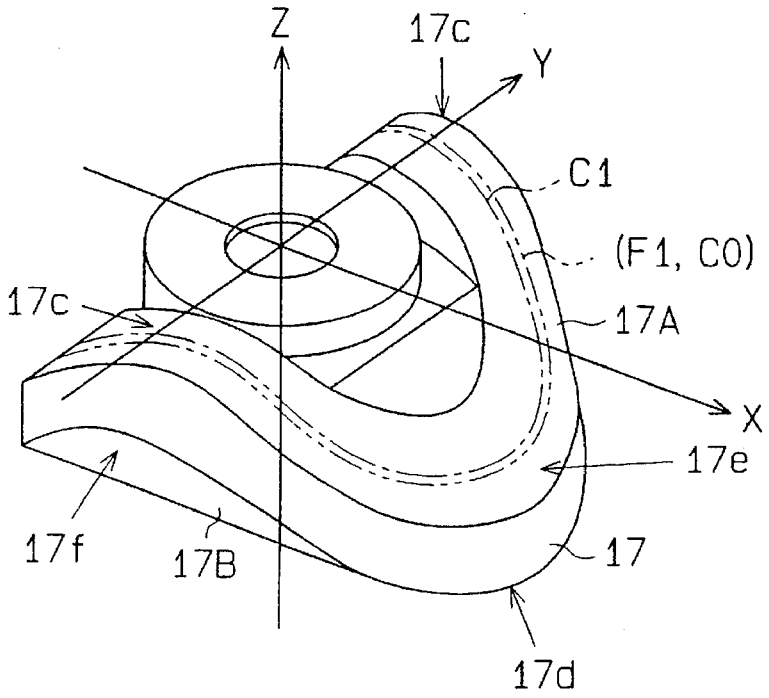
FIG. 3 is a perspective view showing a wave cam with a predetermined cylindroid surface according to the first embodiment.

As shown in FIG. 3, both cam surfaces 17A, 17B of the wave cam 17 are formed along a surface of a predetermined imaginary cylindroid (hereinafter referred to as the cylindroid surface). cross-sectional views of the wave cam 17 along line segments perpendicular to a line connecting two first portions 17*c* of the cam surface 17A each show identical contours. The first portions 17*c* each move a piston 16 to its top dead center position in the associated cylinder bore 11*a*. Cross-sectional views of the wave cam 17 taken along line segments perpendicular to a line connecting two first position 17*d* of the cam surface 17B each show identical contours. The first portions 17*d* each move a piston 16 to its top dead center position in the associated cylinder bore 12*a*. The above cylindroid surface (the arched surface including the cylindrical surface) is defined by moving a straight line (a generatrix) along the contour, or director curve (the directrix). Provided that a Z axis coincides with the axis L0, and that an X axis is orthogonal to a line connecting the two first portions 17*c*, which move the corresponding head of the pistons to the top dead center position, the above-described cylindroid surface is represented by the following equation (1):

$$Z=f(x) \tag{1}$$

Figure 4:
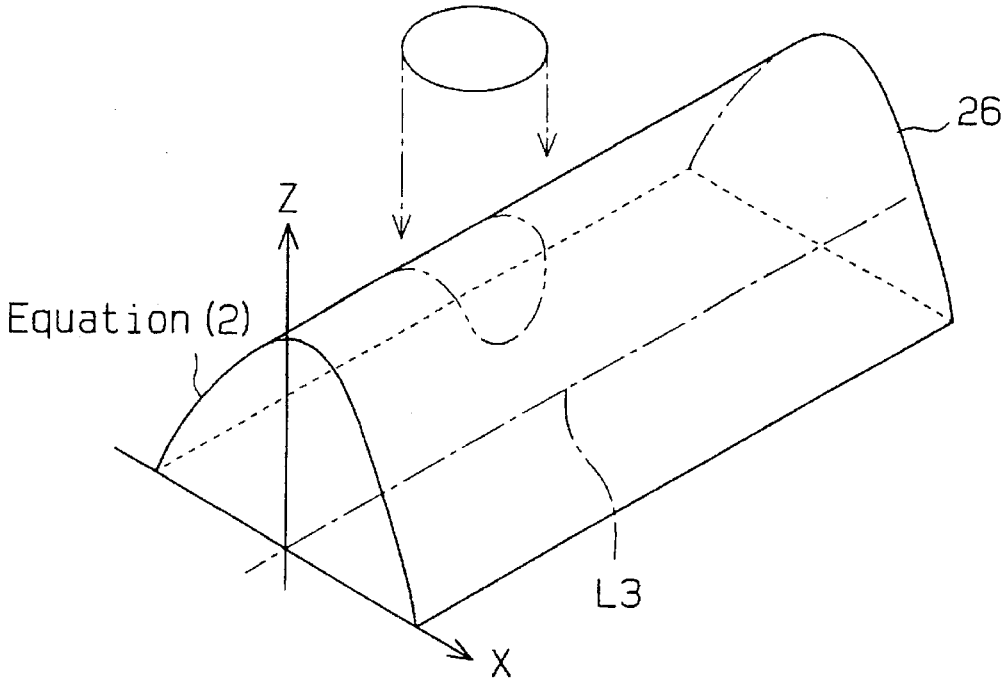
FIG. 4 is a perspective view of a conceptual parabolic surface according to the first embodiment.

The curved surface of each cam surface 17A, 17B is defined by a parabola, which is obtained from the next equation (2) in which X and Z are used as parameters, as the director curve. An imaginary parabolic semicylindroid is generated from the director curve. As shown in FIG. 4, the parabolic semicylindroid surface (hereinafter referred to as parabolic surface) 26 is cut from above along a circle to obtain the curved surfaces of each cam surface 17A, 17B. Two of such parabolic surfaces 26 are combined back to back on the front and rear sides of the wave cam 17 to form the cam surfaces 17A, 17B. The parabolic surface 26 of the semicylindroid is generated by the director curve represented in the following equation (2):

$$Z=-\alpha\cdot X^2+\beta \tag{2}$$

($\alpha$ and $\beta$ are constants)

The two first portions 17*c* (the highest portions on the parabolic surface 26) on the cam surface 17A are separated from each other by an angular interval of 180 degrees. Two second portions 17*e* on the cam surface 17A are also separated from each other by an angular interval of 180 degrees. The first portions 17*c* are separated from the second portions 17*e* by an angular interval of 90 degrees. Two second portions 17*f* on the opposite cam surface 17B are positioned back to back with the first portions 17*c* of the cam surface 17A. In the same manner, the first portions 17*d* on the opposite cam surface 17B are positioned back to back with the second portions 17*e* of the cam surface 17A. The first portions 17*c* on the cam surface 17A move each piston 16 to its top dead center position in the cylinder bore 11*a* while the second portions 17*e* move each piston 16 to its bottom dead center position in the cylinder bore 11*a*. The first portions 17*d* on the cam surface 17B move each piston 16 to its top dead center position in the cylinder bore 12*a* while the second portions 17*f* move each piston 16 to its bottom dead center position in the cylinder bore 12*a*.

For smooth reciprocation of each piston 16, the distance between each associated pair of shoes 18, 19 at the respective centers Q1, Q2 of the spherical surfaces 18*a*, 19*a* is required to be constant. That is, the distance between the movement curves F1, F2 on the associated cam surfaces 17A, 17B must be constant along the direction of the axis L0. In order to satisfy this requirement, two conditions must be fulfilled.

The first condition is that the cam surfaces 17A, 17B of the wave cam 17 have the same contour. The second condition is that the first portions 17*c*, 17*d* of the respective cam surfaces 17A, 17B, which move the corresponding head of each piston 16 to the top dead center position, and the second portions 17*e*, 17*f* of the respective cam surfaces 17A, 17B, which move the corresponding head of each piston 16 to the bottom dead center position, have symmetrical contours.

The first condition is satisfied by employing the parabolic surface 26 cut along a circle as described above for each cam surface 17A, 17B. The second condition is satisfied by the cam surfaces 17A, 17B having a contour of a sine wave curve. In this embodiment, provided that the rotation angle of the wave cam 17 is indicated by 8 and the stroke of the piston 16 is indicated by H, the relationship between the displacement of the centers Q1, Q2 of the respective shoes 18, 19 in the direction of Z axis and the rotation angle θ is indicated by the following equation (3):

$$Z(\theta)=(H/2)\cdot\cos(2\theta) \tag{3}$$

Since the cam surfaces 17A, 17B of the wave cam 17 have identical contours in this embodiment, a description of only the surface 17A will be given below. The rotation angle θ of the wave cam 17 is defined as zero degrees when the piston 16 is at the top dead center position in the cylinder bores 11*a*, 12*a*. The Z axis coincides with the axis L0 of the drive shaft 13. The Y axis is parallel to the axis L3 of the parabolic surface 35 which constitutes the cam surface 17A. The X axis is parallel to the axis L3 of the parabolic surface 26, which constitutes the cam surface 17B.

Figure 5:
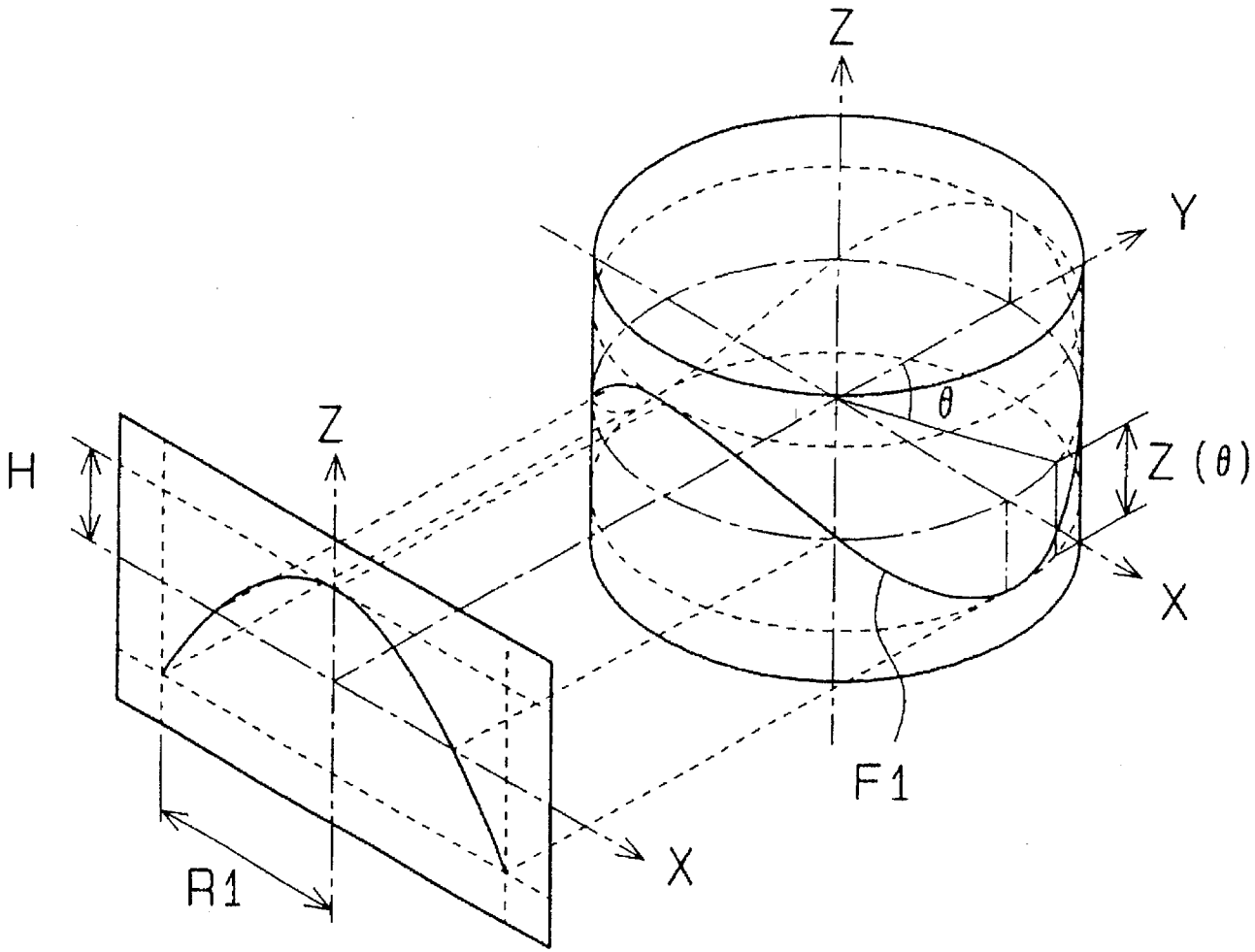
FIG. 5 is a diagram conceptually showing a movement curve (orbital path) of a wave cam surface according to the first embodiment.

As shown in FIG. 5, when the equation (3) is projected onto an X-Z plane, the X coordinate of Z(θ) is represented by the following equation (4):

$$X(\theta)=R1\cdot\cos\theta \tag{4}$$

R1 indicates the radius of the circumference C0. From the equations (3) and (4), the relationship between the Z coordinate and the X coordinate is represented by the following equation (5):

$$\begin{aligned} Z(\theta) &= (H/2)\cdot\cos(2\theta) \\ &= (H/2)\cdot(1-2\cdot\sin^2\theta) \\ \therefore Z(X) &= (H/2)\cdot(1-2X^2/R1^2) \\ &= H/2-H\cdot X^2/R1^2 \end{aligned} \tag{5}$$

The equation (5) represents a parabola and the following equation (6) is derived from the equations (2) and (5).

$$\alpha=H/R1^2$$
$$\beta=H/2 \tag{6}$$

Namely, employment of the parabolic surface 26, which is generated from the director curve satisfying the equation (6), reciprocates the pistons 16 smoothly.

When the drive shaft 13 and the wave cam 17 are integrally rotated, the motion of the wave cam 17 reciprocates each piston 16 inside its associated cylinder bore 11*a*, 12*a* via the shoes 18, 19. As the piston 16 is moved from its top dead center position to its bottom dead center position in the associated cylinder bore 11*a*, 12*a* during the suction stroke, refrigerant gas is introduced into the bores 11*a*, 12*a* from suction chambers 20 through suction valve 21 and suction ports 22. The piston 16 is then moved from its bottom dead center position to its top dead center position during the compression stroke to pressurize the refrigerant gas in the cylinder bores 11*a*, to a predetermined value. This discharges the compressed gas into discharge chambers 25 through discharge valves 23 and discharge ports 24.

Figure 6:
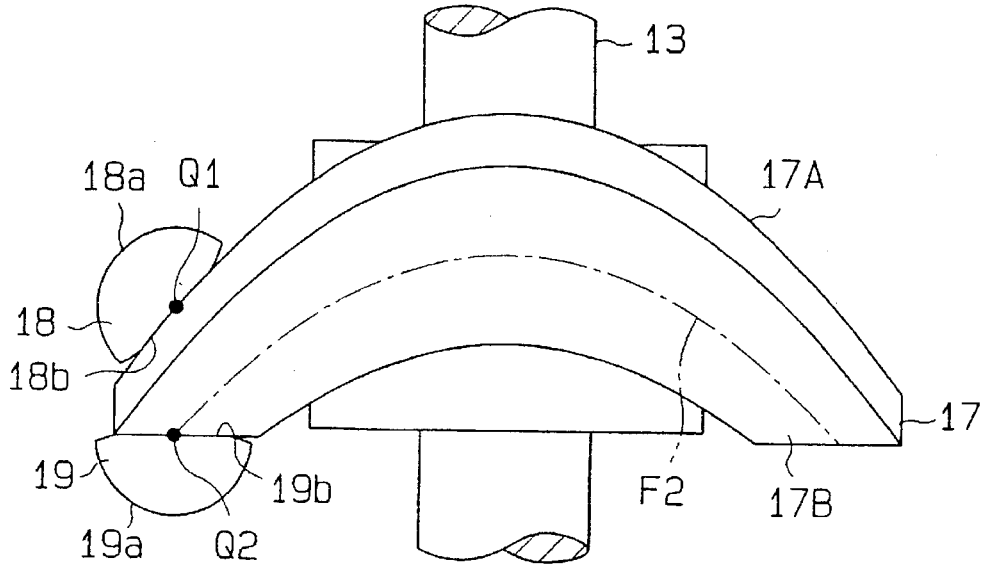
FIG. 6 is a plan view showing a wave cam comprising the predetermined cylindroid surface according to the first embodiment.
Figure 7:
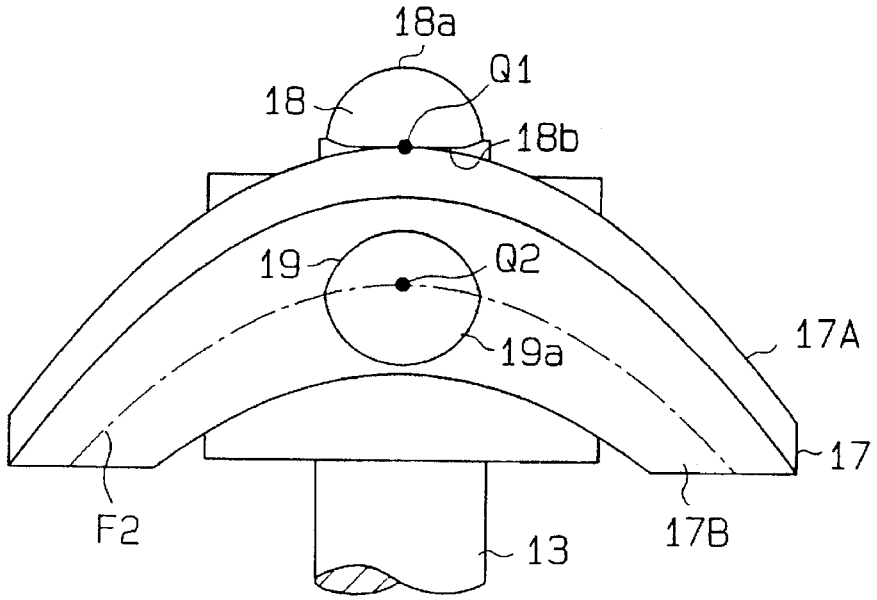
FIG. 7 is a plan view showing the wave cam comprising the predetermined cylindroid surface according to the first embodiment.
Figure 8:
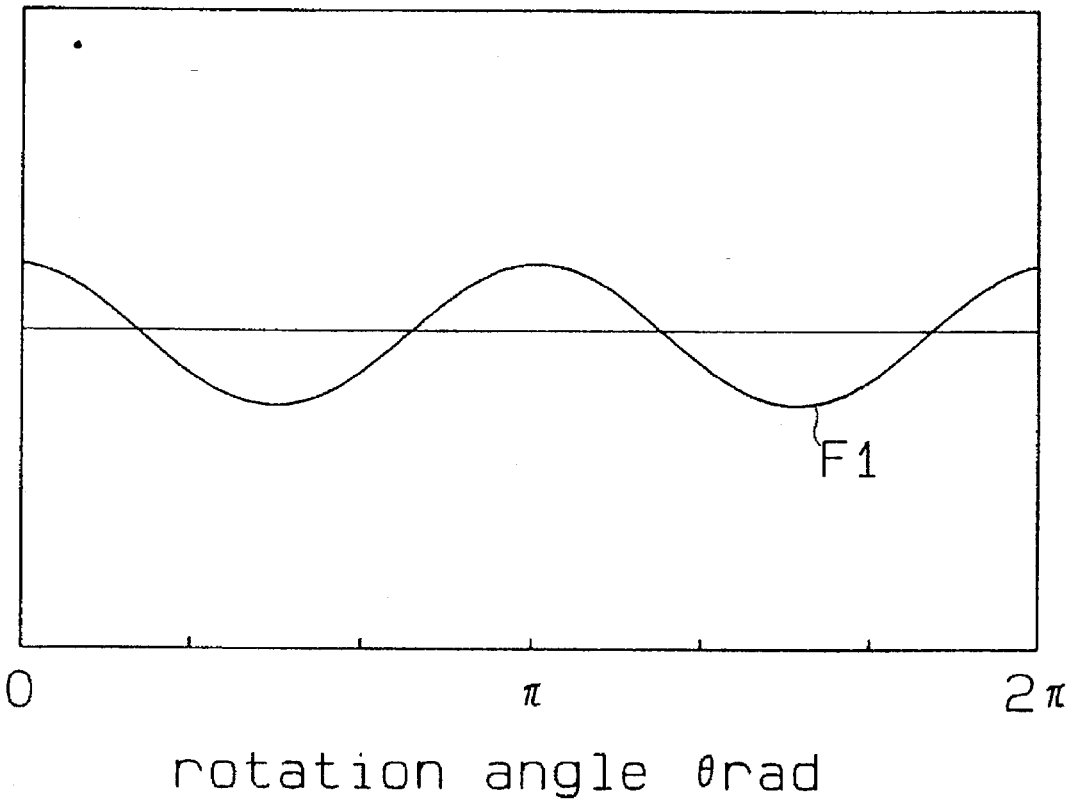
FIG. 8 is a diagram showing a displacement cycle of the wave cam contour according to the first embodiment.

The sequential stages, including intake of refrigerant gas, compression, and discharging, are each performed twice as the wave cam 13 and the drive shaft 13 are integrally rotated once. During the rotation of the wave cam 17, the shoes 18, 19 convert the rotation of the wave cam 17 to reciprocation of the pistons 16. As shown in FIGS. 6 and 7, the shoes 18, 19 rotate relatively about the drive shaft 13 with their flat surfaces 18*b*, 19*b* kept in linear contact with the associated cam surfaces 17A, 17B of the wave cam 17 along the respective movement curves F1, F2. FIG. 7 shows a plan view of the wave cam 17 rotated 90 degrees from the state shown in FIG. 6. During rotation of the wave cam 17, the centers Q1, Q2 of the spherical surfaces 18*a*, 19*a* of the shoes 18, 19, respectively, are periodically displaced in cycles having a profile shown in FIG. 8. The phase of the movement curve F2 on the cam surface 30*b*, satisfying the above requirements, is offset π/2 (not shown) from the phase of the movement curve F1 on the cam surface 30*a* shown in FIG. 8. Therefore, the interval between the two curves F1, F2 in the direction of the Z axis (i.e. direction of the drive shaft 13) is constantly equal.

Figure 2:
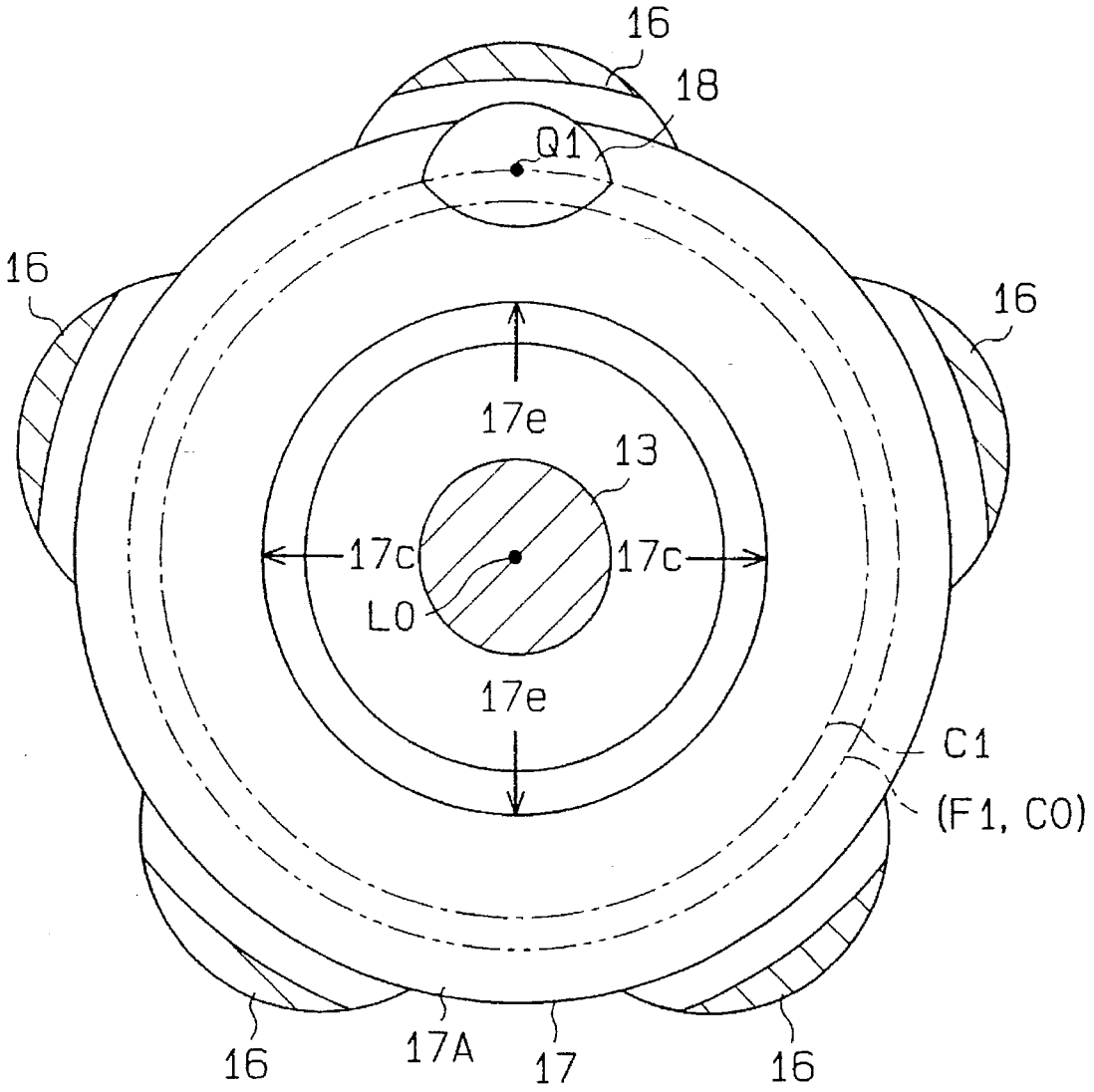
FIG. 2 is a cross-sectional view of the compressor of FIG. 1 taken along line 2—2.
Figure 9:
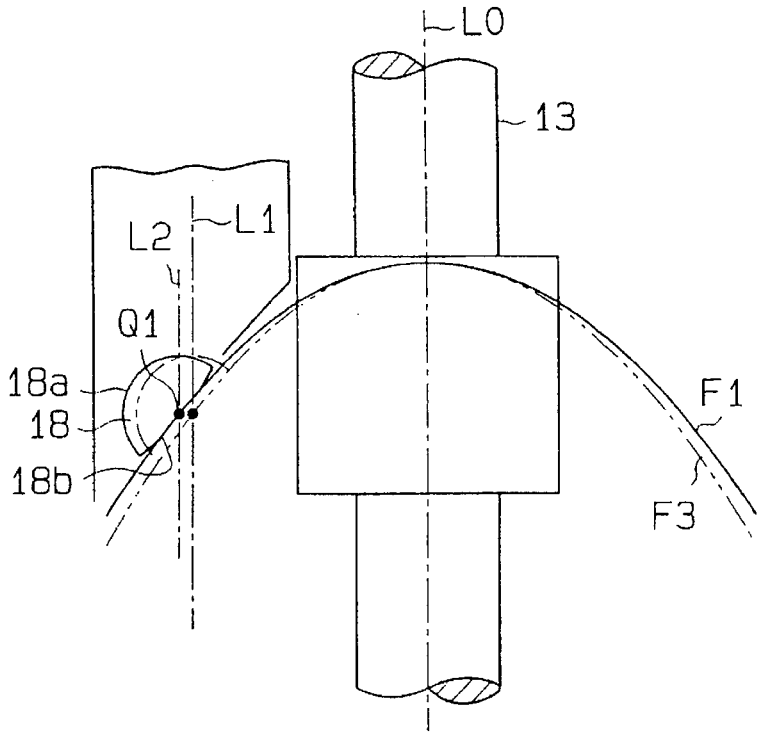
FIG. 9 is a schematic plan view of the wave cam according the first embodiment.

The wave cam type compressor according to the present embodiment has a further characteristic. That is, as shown in FIGS. 1 through 3, an imaginary circumference C1, or imaginary circle corresponds to the arrangement of the axes L1 of the cylinder bores 11*a*, 12*a* on the cam surfaces 17A, 17B. The center of the circumference C1 coincides with the axis L0 of the drive shaft 13. A point following the circumference C1 along each cam surfaces 17A, 17B is displaced in the same manner as a point following the circumference C0 which corresponds to the arrangement of the centers Q1, Q2 of the respective spherical surfaces 18*a*, 19*a*. As shown in FIG. 1 through 3, the radius R1 of the circumference C0 is larger than the radius of the circumference C1. In other words, the distance between the centers Q1, Q2 of the shoes 18, 19 and the axis L0 of the drive shaft 13 is longer than the distance between the axes L1 of the cylinder bores 11*a*, 12*a* and the axis L0 of the drive shaft 13. Accordingly, the orbital path of each center Q1, Q2 of the associated spherical surface 18*a*, 19*a* is outside of the circumference C1. In FIG. 9, a movement curve F3 represents a path of the centers Q1, Q2 of the shoes 18, 19 supposing that the centers Q1, Q2 and the axes L1 of the cylinder bores 11*a*, 12*a* are arranged having equal distance from the axis L0.

The relation between the contours of the cam surfaces 17A, 17B of the wave cam 17 and the stroke H of the piston 16 is represented by the above equation (5). The radius of curvature ρ of the first portions 17*c* (X—O) end 17*a* is represented in the following equation (7). Since the cam surfaces 17A, 17B have identical contours, a description of only the surface 17A will be given below:

$$\rho=|(1+Z'(X)^2)^{2/3}/Z''(X)| \tag{7}$$

The following equation (8) derives from the above equation (5):

$$\begin{aligned} Z'(X) &= dZ/dX = -2(H/R1^2)X \\ Z''(X) &= d^2Z/dX^2 = -2H/R1^2 \end{aligned} \tag{8}$$

$$\begin{aligned} \rho &= |[1+\{-2(H/R1^2)X\}^2]^{2/3}/(-2H/R1^2)| \\ &= |R1^2/2H| \end{aligned}$$

From the above equation (8), it is apparent that a larger radius R1 of the circumference C0, which determines the position of the centers Q1 leads to a larger radius curvature ρ of the first portions 17*c* on the cam surface 17A. In addition, the stroke H of the piston 16 is not required be changed.

Therefore, the centers Q1, Q2 of the associated spherical surfaces 18*a*, 19*a* move along an orbital path corresponding to the circumference C0 which has a larger diameter than the circumference C1. Accordingly, in a microscopic view, the centers Q1, Q2 of the spherical surfaces 18*a*, 19*a* following the movement curve F1, F2, or circumference C0, which has a radius larger than the circumference C1 allows the flat surface; 18*b*, 19*b* of the respective shoes 18, 19 to come into contact with the first portions 17*c*, 17*d* of the respective cam surfaces 17A, 17B over a wider area. Accordingly, the reduced contact pressure between the flat surfaces 18*a*, 19*a* and the associated first portions 17*c*, 17*d* enhances wear resistance and durability.

A second embodiment of a wave cam type compressor according to the present invention will now be described with reference to FIG. 10.

Figure 10:
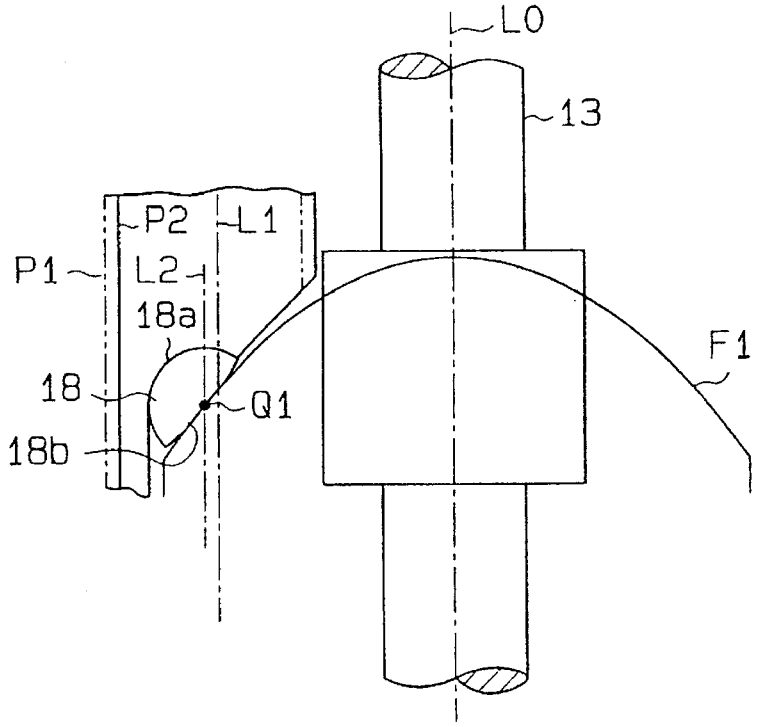
FIG. 10 is a schematic plan view of a wave cam according to a second embodiment of the present invention.

As shown in FIG. 10, the centers Q1, Q2 of the spherical surfaces 18*a*, 19*a* of the shoes 18, 19 are also located on the cam surfaces 17A, 17B in this embodiment. The centers Q1, Q2 of the spherical surfaces 18*a*, 19*a* follow a path outside of the radius of the axes L1 of the cylinder bores 11*a*, 12*a*. That is, the centers Q1, Q2 follow the movement curve F1, which corresponds to the circumference C0. In FIG. 10, the position of the piston 16 in the first embodiment is shown by the double-dotted broken lines and denoted as P1 for comparison with the position of the piston 16 denoted as P2 in this second embodiment. From this drawing, it is apparent that the cylinder bores 11*a*, 12*a* and the pistons 16 (P2) of this second embodiment are located nearer to the axis L0 of the drive shaft 13 than when compared to those of the first embodiment. Accordingly, the circumference C1 of this embodiment has a smaller diameter than that of the first embodiment. Therefore, it is possible to reduce the diameter of the cylinder blocks 11, 12, which results in a smaller compressor.

Although only two embodiments of the present invention have been described herein, it should be apparent to those skilled in the art that the present invention may be embodied in many other specific fume without departing from the spirit or scope of the invention.

Particularly, it should be understood that the present embodiment may be modified in the following forms.

In the above embodiments, the imaginary parabolic surface 26, obtained by using a predetermined parabola as a director curve, is employed as the cam surfaces 17A, 17B. However, the director curve may be a convex curve which is symmetrical about the Z axis, such as a circle or an ellipse.

The cam surfaces 17A, 17B of the wave cam 17 in the above embodiments may be formed with the second portions 17*e*, 17*f*, which move each piston 16 to the bottom dead center position in the cylinder bores 11*a*, 12*a*, having a flat surface and the first portions 17*c*, 17*d*, which move each piston 16 to the top dead center position in the cylinder bores 11*a*, 12*a*, having an elliptical or cylindrical surface. On the other hand, the second portions 17*e*, 17*f* may be formed having an elliptical or cylindrical surface while the first portions 17*c*, 17*d* have a flat surface.

Therefore, the present example and embodiments are to be considered as illustrative and not restrictive and the invention is not to be limited to the details given herein, but may be modified within the scope of the appended claims.

What is claimed:

1. A wave cam type compressor comprising a wave cam body mounted on a drive shaft for integral rotation with the drive shaft, a piston disposed within a cylinder bore and coupled to the cam body, said cam body having a non-planar cam surface for driving the piston, and a shoe interposed between the cam surface and the piston to follow a predetermined orbital path on the cam surface, whereby rotation of the drive shaft is converted into reciprocating movement of the piston with a predetermined piston stroke between a top dead center and a bottom dead center in said cylinder bore to compress fluid supplied to the cylinder bore, said compressor being characterized in that:

said shoe has a spherical surface, and said drive shaft is located with its longitudinal axis spaced at a greater distance from the center of curvature of said spherical surface than from the longitudinal axis of said cylinder bore.

2. The compressor as set forth in claim 1, wherein said cam surface is cylindrical and having a directrix in the form of a plane curve.

3. The compressor as set forth in claim 2, wherein said cam surface includes a part of a surface of an imaginary parabolic cylindroid, said imaginary parabolic cylindroid being defined by a non-finite directrix in the form of a predetermined parabolic curve.

4. The compressor as set forth in claim 3, wherein said parabolic curve is defined by the following equation:

$$Z=-(H/R1^2)X^2+(H/2)$$

wherein Z denotes a value along the Z-coordinate axis coinciding with the longitudinal axis of the drive shaft, and X denotes a value along an X-axis perpendicular to said Z-axis and perpendicular to an axis of the imaginary parabolic cylindroid forming the cam surface;

wherein H denotes the stroke of the piston; and wherein R1 denotes the radius of an imaginary circumference depicted around the axis of the drive shaft, said R1 radius being equal to the distance between the center of curvature of the spherical surface of the shoe and the longitudinal axis of the drive shaft.

5. The compressor as set forth in claim 2, wherein said orbital path includes at least one first portion and at least one second portion respectively associated with the top dead center and the bottom dead center of the piston stroke.

6. The compressor as set forth in claim 5, wherein:

said orbital path has respective pairs of said first and second portions;

said pair of first portions being out of phase one from another by 180°;

said pair of second portions being out of phase one from another by 180°; and each of said first portions and one of said second portions adjacent to said first portion being out of phase one from another by 90°.

7. The compressor as set forth in claim 5, wherein said shoe further includes a flat surface slidably contacting said cam surface, and wherein said spherical surface is slidably coupled to the piston.

8. The compressor as set forth in claim 7, wherein said spherical surface has a center of curvature on the flat surface.

9. A wave cam type compressor comprising a wave cam body mounted on a drive shaft for integral rotation with the drive shaft, a plurality of cylinder bores arranged in a circular manner about the drive shaft, and a plurality of pistons disposed one in each of said cylinder bores and operably connected to the cam body, said cam body having a non-planar cam surface for driving the pistons, a plurality of shoes, each of said shoes being interposed between the cam surface and an associated piston to follow a predetermined orbital path on the cam surface, whereby rotation of the drive shaft is converted into reciprocating movement of each piston, whereby a piston head of each piston moves with a predetermined piston stroke between a top dead center and a bottom dead center in the associated cylinder bore to compress fluid supplied to the cylinder bore, said compressor being characterized in that:

each of said shoes has a spherical surface; and said cam surface has a first imaginary circle corresponding to an arrangement of the centers of curvature of the spherical surfaces, and a second imaginary circle corresponding to the arrangement of the longitudinal axes of said cylinder bores, where said first imaginary circle has a radius larger than the radius of the second imaginary circle.

10. The compressor as set forth in claim 9, wherein said cam surface is cylindrical and continuously convex having a directrix in the form of a plane curve.

11. The compressor as set forth in claim 10, wherein said cam surface includes a part of a surface of an imaginary parabolic cylindroid, said imaginary parabolic cylindroid being defined by a non-finite directrix in the form of a predetermined parabolic curve.

12. The compressor as set forth in claim 11, wherein said parabolic curve is defined by the following equation:

$$Z=-(H/R1^2)X^2+(H/2)$$

wherein Z denotes a value along the Z-coordinate axis coinciding with the longitudinal axis of the drive shaft, and X denotes a value along an X-axis perpendicular to said Z axis and perpendicular to an axis of the imaginary parabolic cylindroid forming the cam surface;

wherein H denotes the stroke of the piston; and wherein R1 denotes the radius of an imaginary circumference depicted around the axis of the drive shaft, said R1 radius being equal to the distance between the center of curvature of the spherical surface of the shoe and the longitudinal axis of the drive shaft.

13. The compressor as set forth in claim 10, wherein said orbital path includes at least one first portion and at least one second portion respectively associated with the top dead center and the bottom dead center of the piston stroke.

14. The compressor as set forth in claim 13, wherein:

said orbital path has respective pairs of said first and second portions;

said pair of first portions being out of phase one from another by 180°;

said pair of second portions being out of phase one from another by 180°; and each of said first portions and one of said second portions adjacent to said first portion being out of phase one from another by 90°.

15. The compressor as set forth in claim 13, wherein said shoe further includes a flat surface slidably contacting said cam surface, and wherein said spherical surface is slidably coupled to the piston.

16. The compressor as set forth in claim 15, wherein said spherical surface has a center of curvature on the flat surface.

17. A wave cam type compressor comprising a wave cam body mounted on a drive shaft for integral rotation with the drive shaft, a plurality of pairs of cylinder bores arranged in a circular manner about the drive shaft, each pair of cylinder bores being opposed to each other on opposite sides of the cam body, and a plurality of double-headed pistons respectively disposed in said cylinder bores and operably connected to the cam body, said cam body having a pair of opposing non-planar cam surfaces for driving the pistons, said cam surfaces having identical cam profiles which are out of phase by 90°, a plurality of pairs of shoes, each pair of said shoes being interposed between the respective cam surfaces and an associated piston to follow a predetermined orbital path on the cam surfaces, whereby rotation of the drive shaft is converted into reciprocating movement of each piston, whereby the piston heads of each piston move with a predetermined piston stroke between a top dead center and a bottom dead center in the associated cylinder bores to compress fluid supplied to the cylinder bore, said compressor being characterized in that:

each of said shoes has a spherical surface; and each of said cam surfaces has a first imaginary circle corresponding to an arrangement of the centers of curvature of the spherical surfaces of the associated shoes, and a second imaginary circle corresponding to the arrangement of the longitudinal axes of the associated cylinder bores, where said first imaginary circle has a radius larger than the radius of the second imaginary circle.

18. The compressor as set forth in claim 17, wherein each of said cam surfaces is cylindrical and continuously convex having a directrix in the form of a plane curve.

19. The compressor as set forth in claim 18, wherein each of said cam surfaces includes a part of a surface of an imaginary parabolic cylindroid, said imaginary parabolic cylindroid being defined by a non-finite directrix in the form of a predetermined parabolic curve.

20. The compressor as set forth in claim 19, wherein said parabolic curve is defined by the following equation:

$$Z=-(H/R1^2)X^2+(H/2)$$

wherein Z denotes a value along the Z-coordinate axis coinciding with the longitudinal axis of the drive shaft, and X denotes a value along an X-axis perpendicular to said Z axis and perpendicular to an axis of the imaginary parabolic cylindroid forming the cam surface;

wherein H denotes the stroke of the piston; and wherein R1 denotes the radius of an imaginary circumference depicted around the axis of the drive shaft, said R1 radius being equal to the distance between the center of curvature of the spherical surface of the shoe and the longitudinal axis of the drive shaft.

21. The compressor as set forth in claim 18, wherein said orbital path includes at least one first portion and at least one second portion respectively associated with the top dead center and the bottom dead center of the piston stroke.

22. The compressor as set forth in claim 21, wherein:

said orbital path has respective pairs of said first and second portions;

said pair of first portions being out of phase one from another by 180°;

said pair of second portions being out of phase one from another by 180°; and each of said first portions and one of said second portions adjacent to said first portion being out of phase one from another by 90°.

23. The compressor as set forth in claim 21, wherein each of said shoes further includes a flat surface slidably contacting said cam surface, and wherein said spherical surface is slidably coupled to the piston.

24. The compressor as set forth in claim 23, wherein said spherical surface has a center of curvature on the flat surface.

* * * * *